US008661985B2

(12) United States Patent
Hubbard et al.

(10) Patent No.: US 8,661,985 B2
(45) Date of Patent: Mar. 4, 2014

(54) LOW-PROFILE IGNITER ASSEMBLIES ADAPTED FOR USE WITH INFLATABLE AIRBAG SYSTEMS

(75) Inventors: Ryan Mark Hubbard, Hooper, UT (US); Jeff Kida, Layton, UT (US)

(73) Assignee: Autoliv ASP, Inc., Ogden, UT (US)

( * ) Notice: Subject to any disclaimer, the term of this patent is extended or adjusted under 35 U.S.C. 154(b) by 0 days.

(21) Appl. No.: 13/450,205

(22) Filed: Apr. 18, 2012

(65) Prior Publication Data

US 2013/0276659 A1 Oct. 24, 2013

(51) Int. Cl.
*C06D 5/00* (2006.01)

(52) U.S. Cl.
USPC ..... 102/530; 280/736; 439/466

(58) Field of Classification Search
USPC ..... 439/620.07; 102/530, 531; 280/735
See application file for complete search history.

(56) References Cited

U.S. PATENT DOCUMENTS

| | | | | |
|---|---|---|---|---|
| 4,225,206 | A | 9/1980 | Roman, Jr. | |
| 5,200,574 | A | 4/1993 | Cunningham et al. | |
| 5,241,910 | A | 9/1993 | Cunningham et al. | |
| 5,772,243 | A | 6/1998 | Green et al. | |
| 6,234,843 | B1 * | 5/2001 | Pavlovic | 439/620.07 |
| 6,250,952 | B1 * | 6/2001 | Shiga et al. | 439/466 |
| 6,276,953 | B1 * | 8/2001 | Gauker et al. | 439/352 |
| 6,460,883 | B1 * | 10/2002 | Nakashima et al. | 280/736 |
| 6,910,902 | B2 * | 6/2005 | Osada | 439/188 |
| 2005/0048843 | A1 * | 3/2005 | Iida | 439/620 |

FOREIGN PATENT DOCUMENTS

| | | |
|---|---|---|
| EP | 0731532 | 7/2000 |

* cited by examiner

*Primary Examiner* — Michelle Clement
*Assistant Examiner* — John D Cooper
(74) *Attorney, Agent, or Firm* — Madson IP, P.C.

(57) ABSTRACT

Low-profile igniter assemblies adapted for use with low-profile inflators as well as conventionally sized inflators are disclosed. Such igniter assemblies can comprise an adaptor, an ignition portion and a plurality of conductors coupled to the ignition portion and extending in a first direction from the ignition portion to an opening of the adapter. A connector is adapted to be slid into the opening in a second direction which is transverse to the first direction associated with the extension of the conductors from the ignition portion to the opening of the adapter. Igniter assemblies can be coupled with a body of an inflatable airbag system inflator, which inflator body may enclose a quantity of gas generant. Methods of making inflators adapted for use with inflatable airbag cushion systems are also included.

8 Claims, 5 Drawing Sheets

LOW-PROFILE IGNITER ASSEMBLIES ADAPTED FOR USE WITH INFLATABLE AIRBAG SYSTEMS

TECHNICAL FIELD

The present disclosure relates generally to inflatable airbag cushions for motor vehicles. More specifically, various embodiments of the present disclosure relate to airbag cushion inflators, automotive connectors for use with such inflators, as well as methods of making inflators and automotive connectors used in inflatable airbag systems for motor vehicles.

BACKGROUND

Modern motor vehicles typically employ various occupant protection systems that self-actuate from an undeployed to a deployed state without the need for intervention by the occupant. Such systems often include an inflatable occupant protection system in the form of a cushion or bag, commonly referred to as an "airbag cushion," which is now a legal requirement for many new vehicles. Such airbag cushions are typically installed in various locations in a vehicle and may deploy into one or more locations within the vehicle between the occupant and certain parts of the vehicle interior, such as the doors, steering wheel, instrument panel, dashboard or the like, to prevent or cushion the occupant from forcibly striking such parts of the vehicle interior.

Various types or forms of occupant protection systems have been developed or tailored to provide desired vehicle occupant protection based on either or both the position or placement of the occupant within the vehicle and the direction or nature of the vehicle collision. For example, driver and passenger inflatable cushion installations have found wide usage for providing protection to drivers and front seat passengers, respectively, in the event of a head-on type of collision. Other installations have found wide usage for providing protection to vehicle occupants in the event of a side impact (e.g., side collision, roll-over).

The airbag cushion is conventionally housed in an uninflated and folded condition to minimize space requirements. In the event of an accident, an accelerometer within the vehicle measures the abnormal deceleration and triggers the expulsion of rapidly expanding gases supplied or produced by a device commonly referred to as an "inflator." The expanding gases fill the airbags, which immediately inflate in front of the driver and/or passenger to provide protection from impact against a windshield, dashboard, or other surfaces of the vehicle interior.

The inflator typically includes an igniter assembly with an initiator (or squib) coupled with an automotive connector for igniting a gas generant housed within the inflator. FIG. 1 is a side view of an example of a conventional prior art igniter assembly 100. In general, an initiator 102 of the igniter assembly 100 includes an ignition portion 104 coupled with a plurality of conductive pins 106 extending axially outward from the ignition portion 104. An automotive connector 108 is coupled to the initiator 102 by receiving the conductive pins 106. Typically, the automotive connector 108 is coupled to the initiator 102 by disposing the automotive connector 108 onto the conductive pins 106 in the same direction that the conductive pins 106 extend from the ignition portion 104, as shown by arrow 110. The ignition portion 104 is typically ignited by receiving an electrical signal from the automotive connector 108 via the conductive pins 106. As shown, conventional automotive connectors 108 typically have a relatively large profile. That is, the size of the automotive connector 108 from the bottom end to the top end (as oriented in FIG. 1) is generally relatively large. Accordingly, the overall size 112 of the igniter assembly from the bottom of the ignition portion 104 to the top of the automotive connector 108 is typically relatively large which can add substantial size to the overall footprint of the inflator and/or can take up space from other inflator components.

BRIEF SUMMARY

Various embodiments of the present disclosure comprise igniter assemblies that include a relatively low profile and are adapted for use with inflators for inflatable airbag cushion systems. In one or more embodiments, an igniter assembly may include an initiator comprising an adapter with an opening formed therein, an ignition portion and a plurality of conductors electrically coupled to the ignition portion and extending in a first direction from the ignition portion to the opening of the adapter. The opening of the adapter may be formed to receive a connector slid into the opening in a second direction transverse to the first direction in which the plurality of conductors extend. In at least some embodiments, a connector may be adapted for disposition within the opening of the adapter. Such a connector may include a plurality of terminals, where each terminal is adapted to be coupled to a respective conductor of the plurality of conductors of the initiator.

Additional embodiments of the present disclosure include airbag system inflators including a low-profile igniter assembly. According to various embodiments, an inflator may include a body enclosing a quantity of gas generant therein. An initiator may be coupled to the body and positioned at least partially within the body to be in sufficient communication with the quantity of gas generant to initiate a reaction for producing a supply of inflation gas during deployment. The initiator may include an adaptor with an opening formed therein, and an entry to the opening positioned at a lateral side of the adapter. The initiator may further include an ignition portion and a plurality of conductors electrically coupled to the ignition portion and extending in a first direction therefrom to the opening of the adaptor. In at least some embodiments, a connector may be adapted for disposition within the opening of the adaptor. The connector may include a plurality of terminals, each adapted to be coupled to a respective conductor of the initiator.

Other embodiments of the present disclosure comprise methods of forming an airbag system inflator including a low-profile igniter assembly. One or more embodiments of such methods may include forming an inflator body and disposing a quantity of gas generant within the body. An initiator may be formed comprising an ignition portion, an adaptor that includes an opening adapted to receive a connector slid therein in a connector insertion direction, and a plurality of conductors electrically coupled to the ignition portion. The plurality of conductors may extend from the ignition portion to the opening of the adaptor in a conductor extension direction that is transverse to the connector insertion direction for receiving a connector into the opening. The initiator may be positioned at least partially in the body so that it is in sufficient proximity with the quantity of gas generant to initiate a reaction for producing a supply of inflation gas during deployment. In at least some embodiments, a connector can be inserted into the opening of the adapter in the connector insertion direction until each terminal of a plurality of terminals is electrically coupled to a respective conductor of the initiator's plurality of conductors.

BRIEF DESCRIPTION OF THE SEVERAL VIEWS OF THE DRAWINGS

Exemplary embodiments of the disclosure will become more fully apparent from the following description and appended claims, taken in conjunction with the accompanying drawings. Understanding that these drawings depict only exemplary embodiments and are, therefore, not to be considered limiting of the disclosure's scope, the exemplary embodiments of the disclosure will be described with additional specificity and detail through use of the accompanying drawings in which:

DETAILED DESCRIPTION

The illustrations presented herein are, in some instances, not actual views of any particular connector, initiator, igniter assembly or inflator, but are merely idealized representations which are employed to describe the present devices and methods. Additionally, elements common between figures may retain the same numerical reference designation.

Figure 2:
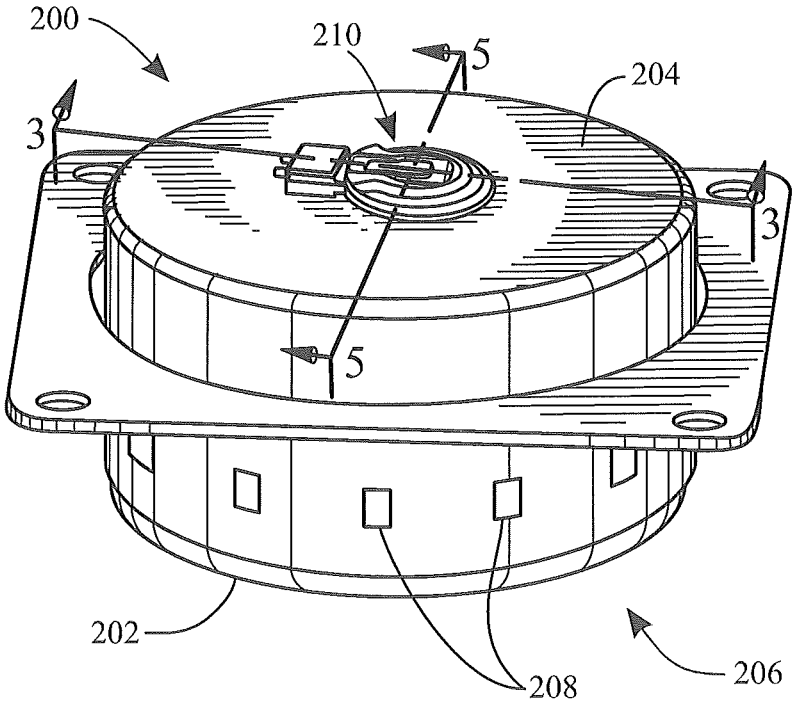
FIG. 2 is an isometric view illustrating an airbag inflator according to at least one embodiment of the present disclosure.

Various embodiments of the present disclosure include airbag cushion inflators for use in inflatable airbag systems for motor vehicles. FIG. 2 is an isometric view illustrating an airbag inflator 200 according to at least one embodiment of the present disclosure. An inflator 200 can be formed as a disk-shaped inflator which includes a diffuser member 202 and a base member 204. The diffuser member 202 and the base member 204 are coupled together in a conventional manner (e.g., by a weld, adhesive, mechanical means, etc.) to form a body 206.

The diffuser member 202 can comprise a dish-shaped configuration with a lateral sidewall around its lateral diameter. The sidewall of the diffuser member 202 can include one or more apertures 208 through which an inflation gas can exit from the inflator 200 during deployment.

The base member 204 can also comprise a similar dish-shaped configuration with a lateral sidewall about its lateral diameter. The base member 204 may be configured to receive and be coupled with at least one igniter assembly 210. That is, the base member 204 may include an aperture adapted to receive and be coupled with one or more igniter assemblies 210.

According to a feature of the present disclosure, the igniter assembly 210 is configured with a relatively low profile in comparison with traditional igniter assemblies. By reducing the profile of the igniter assembly 210, the overall space used by the igniter assembly 210 (e.g., the igniter assembly's 210 "footprint") can be significantly reduced. Such reduction in the footprint of the igniter assembly 210 can make additional space available for other inflator components and/or can allow for a significant reduction in the overall size (or footprint) of the inflator 200. In other words, by freeing up space as a result of the low-profile igniter assembly 210 described herein, the inflator 200 can accommodate additional or larger components, which may improve performance, and/or the inflator 200 can maintain equivalent performance in smaller geometry.

Figure 3:
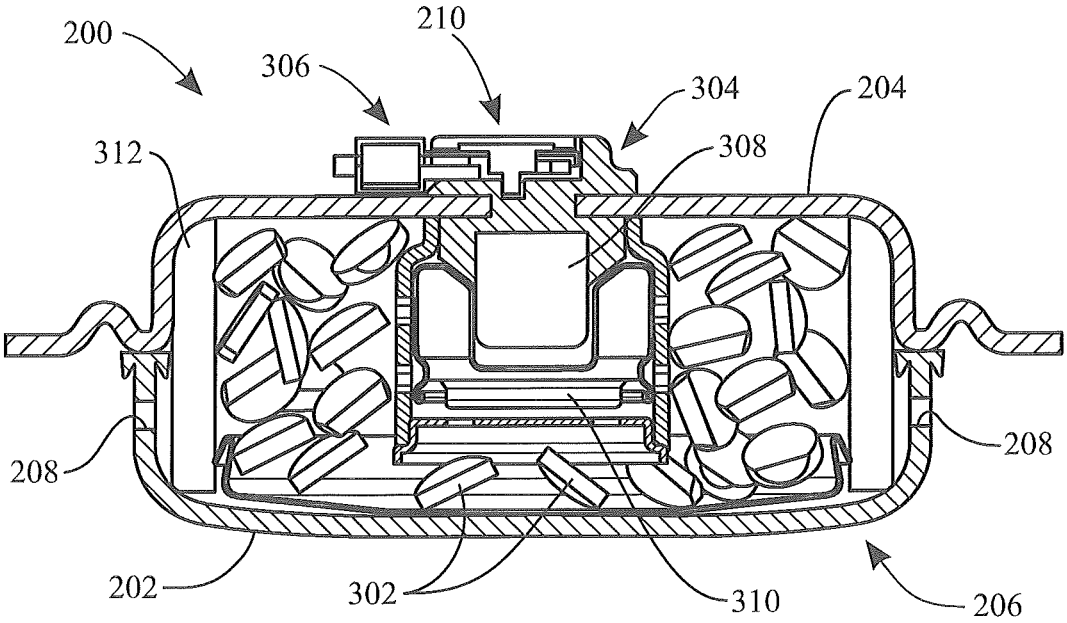
FIG. 3 is a cross-sectioned view of the inflator according to at least one embodiment taken along line 3-3 of FIG. 2.

As shown in FIG. 3, illustrating a cross-sectional view of the inflator 200 taken at along section 3-3 of FIG. 2, the igniter assembly 210 includes an initiator 304 coupled with a connector 306. The initiator 304 is positioned in relation to the body 206 so that it is in sufficient communication with a quantity of gas generant 302 disposed within the body 206 to initiate a reaction of the gas generant 302 for producing (e.g., converting the gas generant 302) a supply of inflation fluid during deployment of the inflator 200. The initiator 304 is generally adapted to initiate such a reaction of the quantity of gas generant 302 upon receipt of an electrical signal via the connector 306, such as may be generated by a sensor (not shown) upon the sensing of a collision. In general, the electrical signal may ignite an ignition portion 308 of the initiator, resulting in hot ignition gases being expelled from the ignition portion 308 toward the gas generant 302. In some implementations an accelerant 310 may be disposed in firing relation to the ignition portion 308 to aid in initiating a reaction of the gas generant 302.

Upon initiating the reaction of the gas generant 302, a supply of inflation gas is produced that flows outward from the body 206 through the apertures 208 in the diffuser member 202. A filter 312 may be provided, which filter 312 is adapted to remove debris and heat from the inflation gas as the inflation gas is flowing to the apertures 208 of the diffuser member 202. The filter 312 can accordingly be positioned within the body 206 of the inflator 200 between the quantity of gas generant 302 and the apertures 208 in the diffuser 202.

Figure 1:
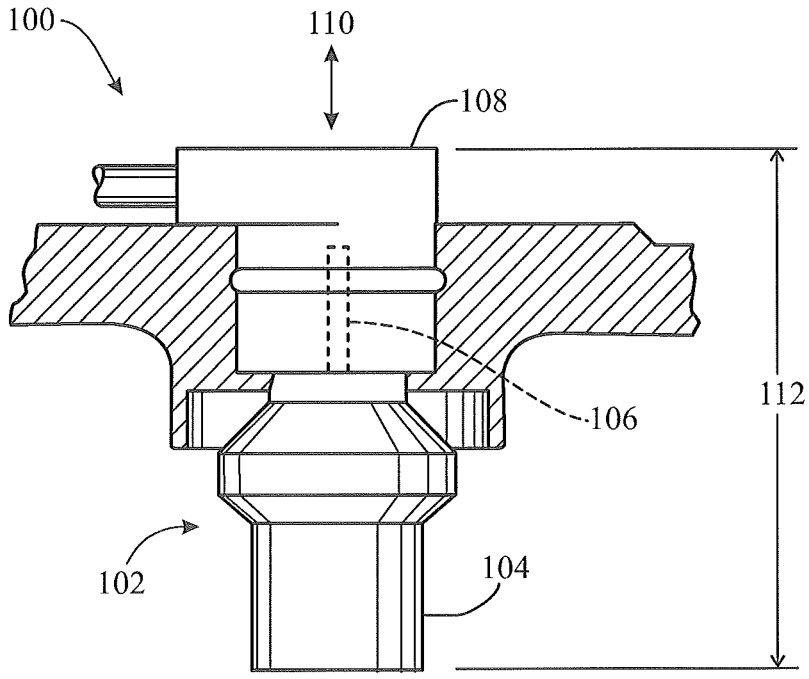
FIG. 1 Prior Art
FIG. 1 is a side view of a prior art example of an igniter assembly.
Figure 4:
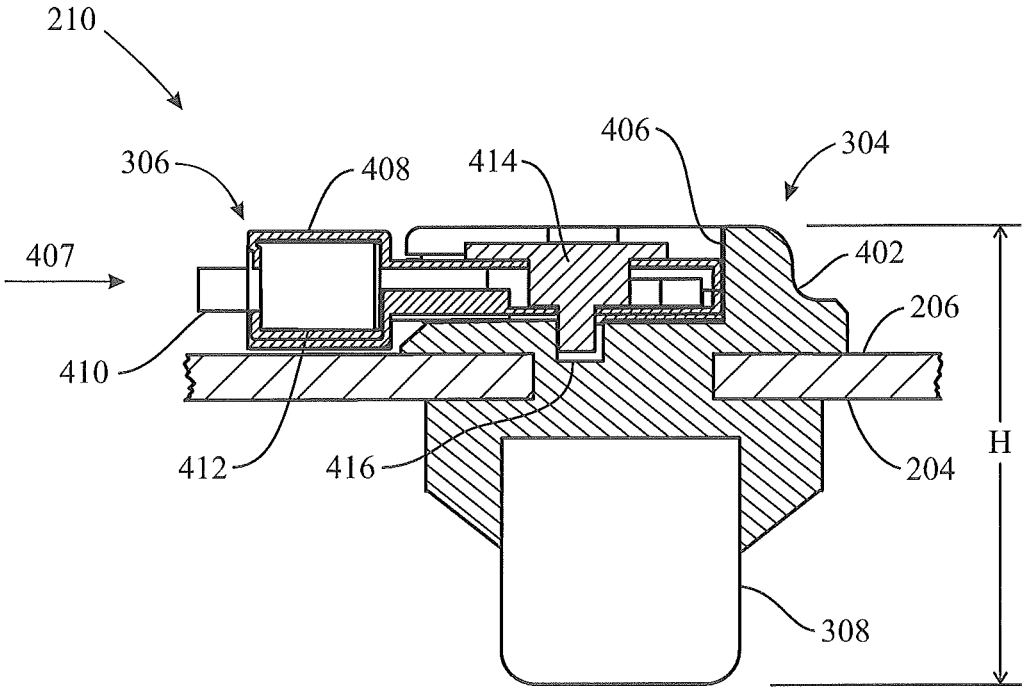
FIG. 4 is a cross-sectioned view of the igniter assembly according to at least one embodiment taken along line 3-3 of FIG. 2.
Figure 5:
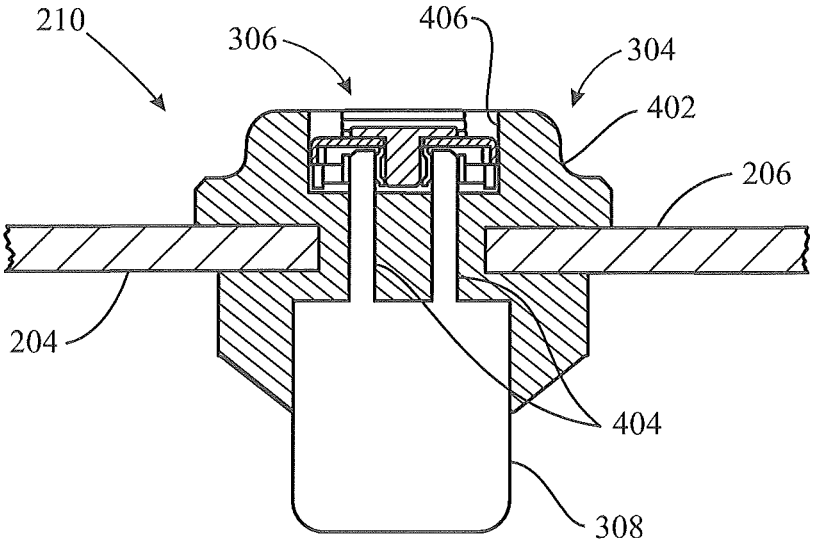
FIG. 5 is a cross-sectioned view of the igniter assembly according to at least one embodiment taken along section 5-5 shown in FIG. 2.

Turning to FIGS. 4 and 5, of which FIG. 4 is a cross-sectioned view of at least one embodiment of the igniter assembly 210 taken along the line 3-3 of FIG. 2 and FIG. 5 is a cross-sectioned view of at least one embodiment of the igniter assembly 210 taken along section 5-5 of FIG. 2. As noted, the igniter assembly 210 includes an initiator 304 coupled with a connector 306. According to various embodiments, the connector 306 is slideably coupled with the initiator 304 from a sideways direction (as oriented in FIG. 4). This side-entry configuration enables the connector 306 to comprise a significantly smaller height, contributing in the substantially smaller profile of the igniter assembly 210. That is, the connector 306 adapted for side-entry coupling can reduce the overall height H from the bottom of the ignition portion 308 to the top of the connector 306 and/or adapter 402. For example, in some conventional assemblies, such as that shown in FIG. 1, the overall height 112 may be about 26.6 mm-28.6 mm. In comparison, at least one embodiment of the present disclosure can result in an overall height H in FIG. 4 of about 15.9 mm, which is a reduction in height of about 40%-44% over conventional assemblies.

The initiator 304 includes an adapter 402 which is shaped to couple the initiator 304 to the body 206 of the inflator 200. In at least some embodiments, the adapter 402 may comprise an injection molded material formed to surround a portion of the sidewall of the base member 204. The ignition portion 308 can include conventional components as are generally known, but not shown in FIGS. 4 and 5, such as an ignition bead surrounded by a pyrotechnic material.

As shown in FIG. 5, the initiator 304 also includes a plurality of conductors 404 coupled to the ignition portion 308. The plurality of conductors 404 may extend from the ignition portion 308, through the adapter 402 to an opening 406 formed in an upper, or proximal, portion of the adapter 402. In some embodiments, the conductors may generally comprise a pin shape. In such embodiments, the conductors 404 may extend into the opening 406 a small distance. For example, in at least one embodiment, the conductors 404 extend into the opening 406 a distance of about 2 millimeters. In other non-limiting examples, the conductors 404 may extend into the opening 406 only a sufficient distance to be exposed in the opening, but at least substantially flat or even with the lower extent of the opening 406. That is, the conductors 404 may extend into the opening 406 about 0 millimeters so that the conductors 404 are at least substantially even with a surface of the opening 406. By way of example and not limitation, the conductors 404 may be configured to extend into the opening 406 anywhere in a range from about 0 millimeters to about 2 millimeters, although other distances may be appropriate according to the specific implementation. Such relatively short pin exposure can reduce or even eliminate bent pins, which bent pins can cause difficulties in coupling the connector 306 with the initiator 304 as well as create short circuits if the pins are bent into contact with one another.

As best shown in FIG. 4, the connector 306 is positioned within at least a portion of the opening 406 of the adapter 402. The connector 306 can be disposed within the opening 406 by sliding the connector 306 into the opening 406 from the side (as oriented in FIG. 4) and in the direction of the arrow 407. That is, the connector 306 may be disposed in the opening 406 by sliding the connector 306 into the opening 406 in a direction 407 transverse to the direction in which the conductors 404 extend from the ignition portion 308.

The connector 306 generally includes a housing 408, in which a plurality of conductive elements 410 may extend. The housing 408 can comprise an electrically insulating material. The conductive elements 410 can be communicatively coupled to a sensor and adapted to transmit an electrical signal generated upon sensing a collision. A ferrite bead 412 may be positioned within the housing 408 to surround the plurality of conductive elements 410. That is, the conductive elements 410 may extend through one or more apertures within the ferrite bead 412. The ferrite bead 412 can provide protection from electromagnetic and radio frequency interference that may tend to be extraneously induced in the conductive elements 410.

According to a feature, various embodiments of the igniter assembly 210 may include an insertion assurance component 414 coupled to a portion of the connector 306. The insertion assurance component 414 can provide an indication that the connector 306 is fully inserted into the opening 406, can retain or lock the connector 306 in the opening 406, or both. In one or more embodiments, as shown in FIG. 4, the insertion assurance component 414 can extend through, or otherwise be coupled to a portion of the connector housing 408. When the connector 306 is fully inserted into the opening 406, a protrusion on the insertion assurance component 414 may enter into an aperture 416 of the adapter 402. The aperture 416 is positioned relative to the plurality of conductors 404 so that the insertion assurance component 414 will engage the aperture 416 when the connector 306 is sufficiently disposed within the opening 406 so the connector 306 will be in electrical contact with the plurality of conductors 404. In addition, when the insertion assurance component 414 is seated into the aperture 416, it can also provide a locking mechanism to ensure that the connector 306 does not unintentionally slide out from the opening 406.

Figure 6:
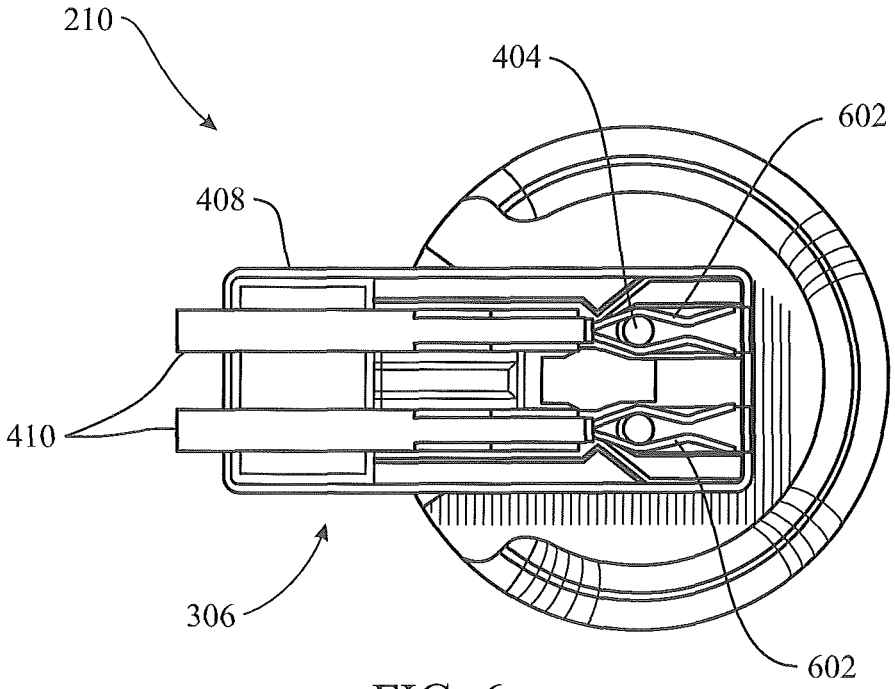
FIG. 6 is a cross-sectioned top view of the igniter assembly illustrating an example of the interior portion of the adapter according to at least one embodiment.

Referring now to FIG. 6, a cross-sectioned top view of the igniter assembly 210 is shown. As illustrated, the plurality of conductive elements 410 extending within the housing 408 of the connector 306 are each coupled with a respective terminal 602. According to various embodiments, the terminals 602 can be integral with a respective conductive element 410, or the terminals 602 can be separate components that are each electrically coupled with a respective conductive element 410 (e.g., crimped, welded, soldered, etc.). Each terminal 602 is adapted to contact a respective conductor 404 of the initiator. In the illustrated embodiments, the conductors 404 are configured as conductive pins, and the terminals 602 are configured as clips to receive and at least partially encompass a respective pin. However, it will be apparent that the pin and clip configuration is merely an example and various other configurations are possible to create an electrical contact between the terminals 602 and the conductors 404.

Figure 7:
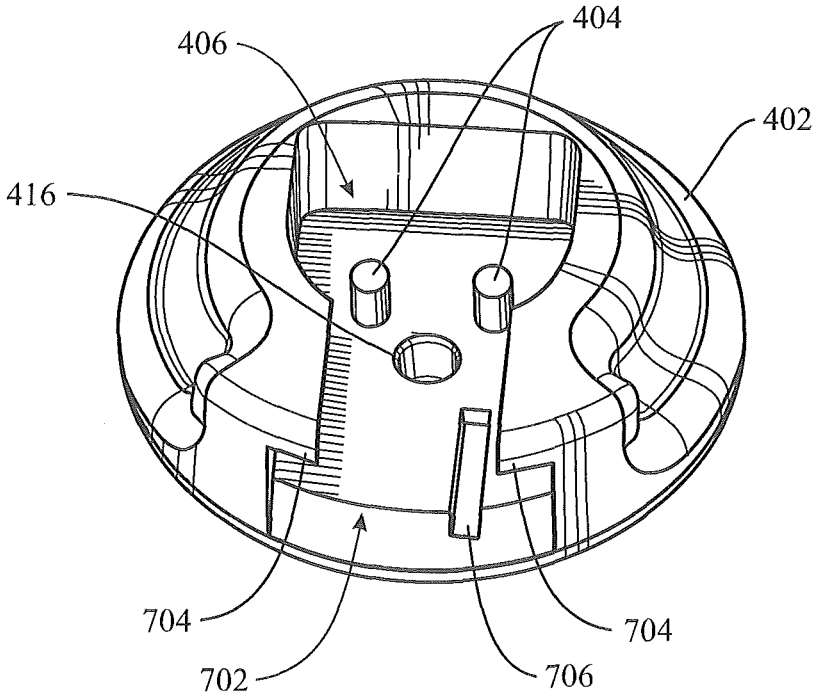
FIG. 7 is an isometric view of the adapter illustrating an example of the opening according to at least one embodiment.

FIG. 7 is an isometric view of an adapter 402 illustrating an example of the opening 406 according to at least one embodiment. The opening 406 is shaped to receive a connector from the side, as opposed to receiving a connector from the top (as oriented in FIG. 7). In other words, the opening 406 is adapted so a connector (e.g., connector 306 in FIG. 3) can slide into the opening in a direction transverse to the direction the conductors 404 extend from the ignition portion 308 (as shown in FIG. 5). In the embodiment illustrated, the opening 406 includes an entry 702 to the opening 406 positioned at a lateral side of the adapter 402 through which a connector can initially enter into the opening 406. In embodiments where an insertion assurance component 414 (see FIG. 4) is employed, the opening 406 includes an aperture 416 to receive the insertion assurance component 414.

In at least some embodiments, the adaptor 402 may be formed to include one or more connector retention features 704 adapted to extend over at least a portion of the opening 406 to restrict movement of an inserted connector. In the embodiment shown in FIG. 7, the connector retention features 704 comprise protrusions adapted to extend over an upper surface of an inserted connector. Such protrusion can restrict movement of an inserted connector in a direction transverse to the direction of connector insertion.

The opening 406 may further include a key slot 706. The key slot 706 can correspond with a projection (not shown) in the housing 408 of a connector (such as connector 306 in FIG. 3). The key slot 706 can accordingly aid in assuring a connector is not inserted upside down, which could result in connecting the terminals 602 of the connector 306 with the wrong conductors 404. In other embodiments, however, the connector 306 can be adapted to be coupled with the adapter 402 in either direction, so that there is effectively no upside or downside to the connector 306.

Figure 8:
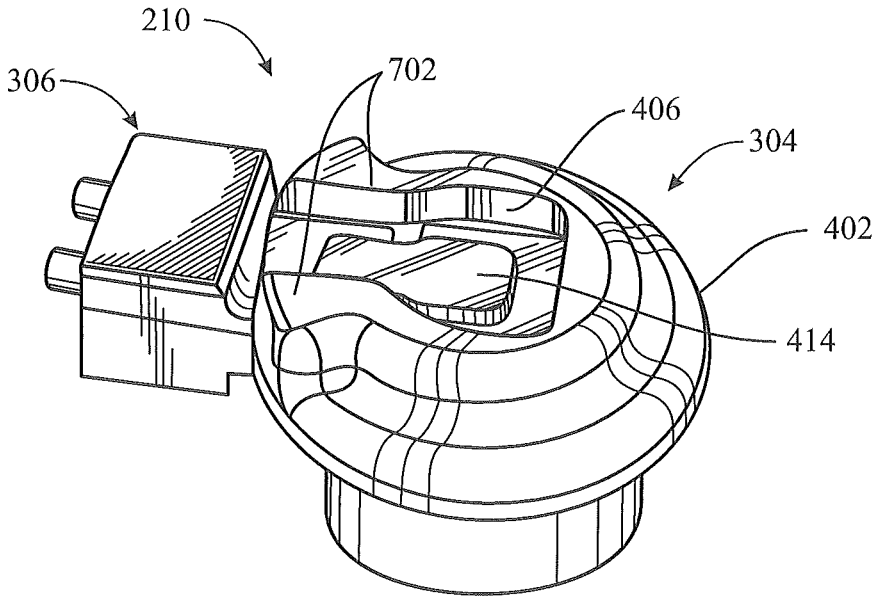
FIG. 8 is an isometric view of an igniter assembly according to at least one embodiment.

FIG. 8 is an isometric view of the igniter assembly 210, showing the connector 306 inserted into the opening 406 of the adapter 402. As shown, the connector retention features 704 extend over a portion of the connector 306. Also, the insertion assurance component 414 is shown in the down position, signifying that the protrusion of the insertion assurance component 414 is inserted into the aperture 416 (shown in FIG. 4) and indicating that the terminals 602 (FIG. 6) are coupled to a respective conductor 404 (FIG. 6) of the initiator 304.

Figure 9:
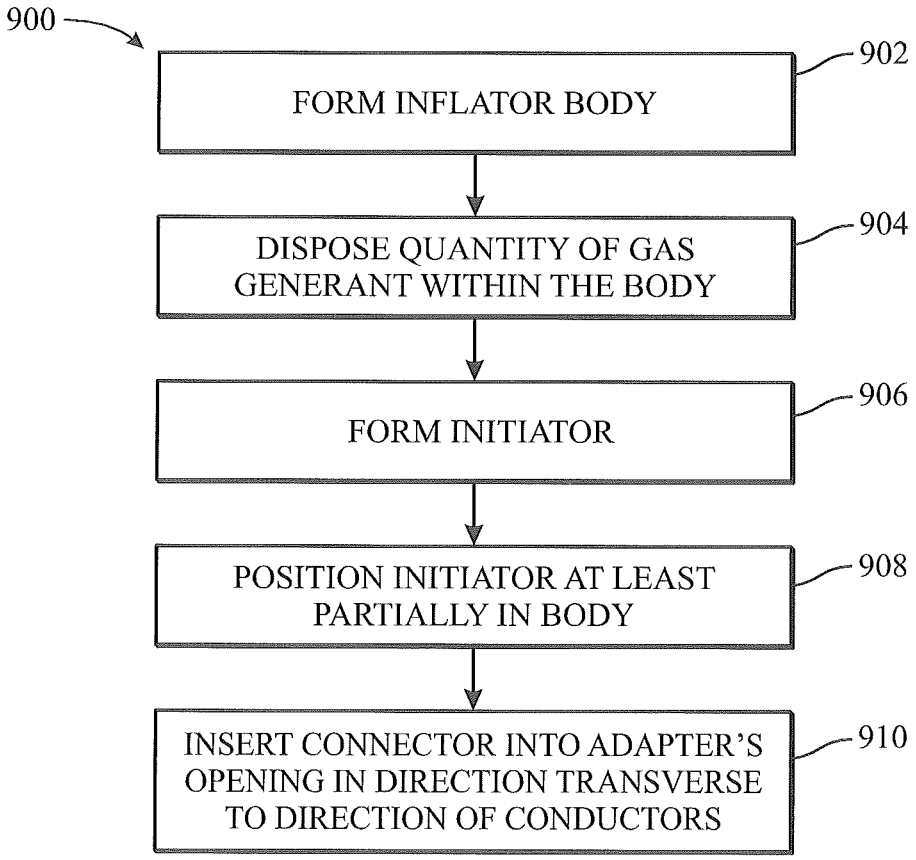
FIG. 9 is a flow diagram illustrating at least one embodiment of a method for forming an inflator.

Additional embodiments of the present disclosure relate to methods of forming inflators for use in airbag assemblies, which inflators include a low-profile igniter assembly. FIG. 9 is a flow diagram illustrating at least one embodiment of a method for forming an inflator including an igniter assembly, such as the igniter assembly 210 illustrated in FIGS. 2-6. With reference to FIG. 9, as well as to the elements of FIGS. 2-7, the method 900 includes forming an inflator body at step 902. For example, an inflator body may comprise a disk-shaped inflator body 206 that includes a diffuser member 202 coupled with a base member 204. A quantity of gas generant, such as gas generant 302, may be disposed within the body at step 904.

At step 906, an initiator is formed with an ignition portion, an adaptor, and a plurality of conductors electrically coupled to the ignition portion and extending from the ignition portion to an opening of the adaptor. For example, the initiator may be embodied similar to the initiator 304, with an adaptor 402, an ignition portion 308, and a plurality of conductors 404, as illustrated in FIGS. 4 and 5. The adaptor 402 can include the opening 406 formed therein and adapted to receive a connector slid in a connector insertion (or second) direction. The plurality of conductors 404 can be electrically coupled to the ignition portion 308 and may extend in a conductor extension (or first) direction from the ignition portion 308 to the opening 406 of the adapter 402, where the conductor extension (or first) direction is transverse to the connector insertion (or second) direction.

At step 908, the initiator (e.g., initiator 304) may be positioned at least partially in the body 206 and within sufficient proximity of the gas generant 302 to initiate a reaction for producing a supply of inflation gas during deployment. While positioning the initiator 304 at least partially in the body 206, the adapter 402 may be disposed so that it is coupled to the base member 204 of the body 206.

At step 910, a connector can be inserted into the opening of the adapter until each terminal of the connector is electrically coupled to a respective conductor of the initiator's plurality of conductors. As has been described herein above, the adapter, such as adapter 402, can include an opening 406 having an entry 702 located at a lateral side, as shown in FIG. 7. Accordingly, the connector, such as connector 306, can be inserted into the opening 406 by sliding the connector 306 from the entry 702 in a second direction that is transverse to the first direction defined by the plurality of conductors 404 of the initiator. According to at least some embodiments, the connector's terminals 602 can comprise a clip that is clipped to a respective pin-shaped conductor 404, as shown in FIG. 6. The connector 602 can also include an insertion assurance component 414 (see FIG. 4) that extends into an aperture 416 in the adapter 402 when the terminals are electrically coupled to a respective conductor.

Although the forgoing method 900 is depicted as a flowchart in which operational acts are described and depicted as a sequential process, it should be understood that many of these acts can be performed in another sequence, in parallel, or substantially concurrently. In addition, the order of the acts may be re-arranged.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A low-profile igniter assembly adapted for use with an airbag system inflator, comprising an initiator including:

an adaptor comprising an opening formed therein;

an ignition portion;

a plurality of conductors electrically coupled to the ignition portion and extending in a first direction from the ignition portion to the opening of the adapter; and a connector for slidable disposition within the opening of the adaptor, the connector being connectable to at least one conductive element and including a plurality of terminals, where each terminal is adapted to couple with a respective conductor of the plurality of conductors of the initiator;

wherein the opening of the adapter has a side-entry configuration to receive the connector in electrically coupling engagement, the connector being slid into the opening in a second direction transverse to the first direction in which the plurality of conductors extend.

2. The igniter assembly of claim 1, wherein the connector has a housing that houses a ferrite bead, the ferrite bead having at least one aperture through which the at least one conductive element extends.

3. The igniter assembly of claim 1, wherein each respective conductor is a conductive pin and each terminal of the plurality of terminals comprises a clip adapted to receive and at least partially encompass a respective conductor.

4. The igniter assembly of claim 1, further comprising an insertion assurance component coupled to the connector and adapted to extend into an aperture in the adaptor when the connector is inserted fully into the opening of the adaptor.

5. The igniter assembly of claim 1, wherein each conductor of the plurality of conductors of the initiator comprises a conductive pin.

6. The igniter assembly of claim 1, wherein the adapter includes an entry through which a connector can be slid into the opening, which entry is positioned at a lateral side of the adapter.

7. The igniter assembly of claim 1, wherein a portion of the adapter is shaped to extend over at least a portion of the opening to restrict movement of an inserted connector transverse to the second direction.

8. The igniter assembly of claim 1, further comprising a key slot in the opening and the connector has a corresponding projection, the alignment of the key slot and the projection assuring that the connector is slidably inserted in the proper orientation.

* * * * *